US009242296B2

(12) United States Patent
Kaneko et al.

(10) Patent No.: US 9,242,296 B2
(45) Date of Patent: Jan. 26, 2016

(54) RARE EARTH MAGNET MATERIAL AND METHOD FOR PRODUCING THE SAME

(75) Inventors: Yuji Kaneko, Nagoya (JP); Yukio Takada, Nisshin (JP)

(73) Assignee: KABUSHIKI KAISHA TOYOTA CHUO KENKYUSHO, Nagakute (JP)

( * ) Notice: Subject to any disclaimer, the term of this patent is extended or adjusted under 35 U.S.C. 154(b) by 1044 days.

(21) Appl. No.: 13/384,901

(22) PCT Filed: Sep. 10, 2010

(86) PCT No.: PCT/JP2010/065660

§ 371 (c)(1), (2), (4) Date: Jan. 19, 2012

(87) PCT Pub. No.: WO2011/043158

PCT Pub. Date: Apr. 14, 2011

(65) Prior Publication Data

US 2012/0114515 A1 May 10, 2012

(30) Foreign Application Priority Data

Oct. 10, 2009 (JP) ..... 2009-235800

(51) Int. Cl.
*B22F 3/12* (2006.01)
*H01F 1/057* (2006.01)
(Continued)

(52) U.S. Cl.
CPC ..... *B22F 1/0088* (2013.01); *B22F 3/24* (2013.01); *C22C 33/0278* (2013.01); *H01F 41/0246* (2013.01); *H01F 1/0577* (2013.01); *H01F 41/0293* (2013.01)

(58) Field of Classification Search
CPC ... H01F 41/0293; H01F 1/0577; H01F 1/057; B22F 2998/10; B22F 3/24
See application file for complete search history.

(56) References Cited

U.S. PATENT DOCUMENTS

2005/0284545 A1 12/2005 Komuro et al.
2007/0071979 A1 3/2007 Komuro et al.
(Continued)

FOREIGN PATENT DOCUMENTS

CN 1713313 A 12/2005
CN 1945766 A 4/2007
(Continued)

OTHER PUBLICATIONS

Machine translation of JP2003-282312A. Oct. 2003.*
(Continued)

*Primary Examiner* — Jie Yang
*Assistant Examiner* — Xiaowei Su
(74) *Attorney, Agent, or Firm* — Oliff PLC

(57) ABSTRACT

A method for producing a rare earth magnet material which allows efficient Dy or the like diffusion into an inside thereof. This method includes a preparation step of preparing a powder mixture of magnet powder including one or more rare earth elements including neodymium, boron, and the remainder being iron; and neodymium fluoride powder; a heating step of heating a compact of the powder mixture and causing oxygen around magnet powder particles to react with the fluoride powder, thereby obtaining a lump rare earth magnet material in which neodymium oxyfluoride is wholly distributed. The fluoride powder traps oxygen enclosed in the powder mixture and fixes the oxygen as stable NdOF. When Dy is diffused into this rare earth magnet material, Dy smoothly enters into its inside without being oxidized at grain boundaries. Consequently, coercivity of the entire rare earth magnet material can be efficiently increased without wasting scarce Dy.

6 Claims, 8 Drawing Sheets

CONTAINING FLUORIDE POWDER

(51) Int. Cl.

| | |
|---|---|
| ***B22F 1/00*** | (2006.01) |
| ***B22F 3/24*** | (2006.01) |
| ***C22C 33/02*** | (2006.01) |
| ***H01F 41/02*** | (2006.01) |

(56) References Cited

U.S. PATENT DOCUMENTS

| | | | | |
|---|---|---|---|---|
| 2007/0134519 | A1 | 6/2007 | Komuro et al. | |
| 2008/0286595 | A1 * | 11/2008 | Yoshimura et al. | 428/548 |
| 2009/0200885 | A1 | 8/2009 | Kikuchi et al. | |

FOREIGN PATENT DOCUMENTS

| | | | | |
|---|---|---|---|---|
| CN | 101331566 | A | | 12/2008 |
| JP | A-6-244011 | | | 9/1994 |
| JP | 2003282312 | A | * | 10/2003 |
| JP | A-2003-282312 | | | 10/2003 |
| JP | A-2006-66853 | | | 3/2006 |
| JP | WO 2006/043348 | A1 | | 4/2006 |
| JP | A-2007-116142 | | | 5/2007 |
| JP | A-2007-194599 | | | 8/2007 |
| JP | A-2008-147634 | | | 6/2008 |
| JP | A-2008-270699 | | | 11/2008 |
| JP | A-2009-153356 | | | 7/2009 |
| JP | A-2009-183069 | | | 8/2009 |

OTHER PUBLICATIONS

Oct. 21, 2011 International Preliminary Report on Patentability issued in International Patent Application No. PCT/JP2010/065660 (with translation).

Office Action issued in Chinese Patent Application No. 201080040932.9 dated Jun. 30, 2014 (with translation).

Oct. 8, 2013 Office Action issued in Chinese Patent Application No. 201080040932.9 (w/ translation).

Nakamura, H., "Nd—Fe—B Sintered Magnets Produced by the Grain Boundary Diffusion Process," Bulletin of Topical Symposium of the Magnetics Society of Japan, vol. 147, pp. 13-18 (with English Abstract).

International Search Report issued in International Patent Application No. PCT/JP2010/065660 dated Dec. 14, 2010 (with translation).

* cited by examiner

NOT CONTAINING FLUORIDE POWDER

CONTAINING FLUORIDE POWDER

EPMA images of a sintered rare earth magnet produced with mixing $NdF_3$ powder and applying Dy-vapor diffusion treatment EPMA images of a sintered rare earth magnet produced with mixing $DyF_3$ powder and applying Dy-vapor diffusion treatment EPMA images of a sintered rare earth magnet produced with mixing $TbF_3$ powder EPMA images of a magnet obtained by applying $DyF_3$ coating and heat treatment to a sintered rare earth magnet containing no fluoride powder EPMA image of Dy of a sintered rare earth magnet containing no fluoride powder

RARE EARTH MAGNET MATERIAL AND METHOD FOR PRODUCING THE SAME

TECHNICAL FIELD

The present invention relates to a rare earth magnet material from which various kinds of rare earth permanent magnets having good magnetic properties and corrosion resistance can be obtained, and a method for producing the same.

BACKGROUND ART

Rare earth magnets (especially permanent magnets) typically exemplified by Nd—Fe—B magnets exhibit very high magnetic properties. Since the use of rare earth magnets can realize downsizing, output power enhancement, density enhancement, environmental burden reduction and the like of electromagnetic devices and electric motors, application of rare earth magnets is being investigated in a wide range of fields. However, in order to achieve practical application, it is requested that good magnetic properties of rare earth magnets are exhibited stably for a long time even under severe environments. Therefore, research and development are actively conducted to enhance corrosion resistance (demagnetization resistance), coercivity and the like of rare earth magnets while maintaining or improving high residual magnetic flux density. Descriptions relating to these researches are disclosed, for example, in the following literature.

CITATION LIST

Patent Literature

[PTL 1] Japanese Unexamined Patent Publication No. H06-244011

[PTL 2] International Publication No. WO2006/043348

Non-Patent Literature

[NPL 1] Bulletin of Topical Symposium of the Magnetics Society of Japan; Hajime Nakamura; the 147th, pp. 13-18 (2006)

SUMMARY OF INVENTION

Technical Problem

The above PTL 1 states that corrosion resistance of sintered rare earth magnets can be improved by applying fluorination treatment and heat treatment of 400 to 500 deg. C. to sintered Nd—Fe—B rare earth magnets to form a compound layer of about 5 to 10 μm comprising $NdF_3$ and/or NdOF on a surface layer thereof. The corrosion resistance improvement, however, is limited to surface parts of sintered rare earth magnets where $NdF_3$ and/or NdOF are formed.

PTL 2 and NPL 1 propose methods for applying heat treatment while keeping dysprosium fluoride ($DyF_3$) present on a surface of a sintered rare earth magnet in order to perform grain boundary diffusion of dysprosium (Dy), which is effective to improve coercivity of the sintered rare earth magnet. However, the present inventors' research and investigation showed that because Dy is diffused from the vicinity of an outer surface of a sintered rare earth magnet, coercivity decreases in a direction from the surface toward an inner part and structure of the outermost surface is destroyed, and because excessive Dy is solid-solved, the improvement in coercivity is small and therefore these methods are not efficient.

The present invention has been made in view of these circumstances. That is to say, it is an object of the present invention to provide a rare earth magnet material whose coercivity can be improved more efficiently at least by diffusion of Dy or the like than those of conventional rare earth magnets, and a method for producing the same.

Solution to Problem

The present inventors have earnestly studied and made trial and error in order to solve the problems. As a result, the present inventors have found that when a diffusing element which can improve coercivity of a rare earth magnet is diffused into an inner part thereof, oxygen (O) present within the rare earth magnet in the form of oxides or the like reacts with the diffusing element and blocks diffusion of the diffusing element into the inner part. In the meanwhile, the present inventors also have found that neodymium oxyfluoride formed by bonding of O present within the rare earth magnet to neodymium (Nd) and fluorine (F) is far stabler than oxides of other rare earth elements (hereinafter referred to as "R"). Moreover, the present inventors have newly found that when neodymium oxyfluoride is formed in an inner part, a diffusing element diffuses sufficiently into the inner part of the rare earth magnet. The present inventors have further studied about these findings and completed the following present invention.

<Method for Producing Rare Earth Magnet Material>

(1) That is to say, a method for producing a rare earth magnet material of the present invention comprises a preparation step of preparing a powder mixture of: magnet powder being powder of a magnet alloy comprising a first rare earth element (hereinafter referred to as "R1") which is one or more rare earth elements, boron (B), and the remainder being iron (Fe) and inevitable impurities with or without a reforming element; and fluoride powder being powder of a fluoride, at least one of the magnet powder and the fluoride powder containing neodymium (Nd); and a heating step of heating a compact of the powder mixture, thereby obtaining a lump rare earth magnet material in which neodymium oxyfluoride which is a reaction product of oxygen (O) or an oxide in the vicinity of particles of the magnet powder, and the fluoride is distributed over all parts including not only a surface part but also an inner part thereof.

(2) According to the production method of the present invention, it is possible to obtain a rare earth magnet material whose coercivity can be efficiently improved by diffusing a diffusing element such as dysprosium (Dy) and terbium (Tb), which is scarce and effective in improving coercivity, into an inner part thereof without wasting the diffusing element. Moreover, various rare earth magnets having very high coercivity can be efficiently obtained by using this rare earth magnet material.

The reason and mechanism why such a good rare earth magnet material is obtained are not fully clear, but at present are assumed as follows.

According to the method for producing a rare earth magnet material of the present invention, in a heating step of heating a powder mixture of fluoride powder and magnet powder, the fluoride powder reacts with an oxide or the like present in the vicinity of particles of the magnet powder to generate neodymium oxyfluoride. This neodymium oxyfluoride is far stabler than other already-existing or newly-formed oxides. Therefore, already-existing oxides in the vicinity of particle surfaces of the magnet powder are easily reduced and changed into neodymium oxyfluoride, and newly-formed oxides easily become neodymium oxyfluoride. Thus the fluoride powder as an oxygen getter traps O mixed in a preparation step, a compacting step or a heating step and makes it difficult to generate oxides other than neodymium oxyfluoride in the vicinity of grain boundaries of magnet powder particles. In other words, O in the vicinity of grain boundaries of the magnet powder particles is fixed in the form of neodymium oxyfluoride. Besides, since the fluoride powder is approximately uniformly dispersed in the powder mixture, according to the present invention it is possible to obtain a rare earth magnet material in which the above action is performed over all parts including an inner part.

If a diffusing element which can improve coercivity is diffused in a lump rare earth magnet material in which neodymium oxyfluoride is thus distributed over all parts including not only a surface part but also an inner part, owing to the presence of stable neodymium oxyfluoride, the diffusing element tend to smoothly enter into the inner part along grain boundaries of magnet alloy particles without being oxidized by O present on the way of diffusion. As a result, the magnet alloy particles located not only in the vicinity of a surface but also in an inner part of the rare earth magnet material tends to be enclosed by the diffusing element, and coercivity of the rare earth magnet material can be further improved as a whole. In addition, since the diffusing element is markedly inhibited from being wastefully trapped by O present in grain boundaries of magnet alloy particles or the like, it is possible to markedly enhance diffusion efficient, which is the ratio of an increase in coercivity to the amount of a diffusing element diffused.

(3) Moreover, neodymium oxyfluoride is very stable as mentioned before, and keeps O securely trapped. Therefore, new reactions such as oxidation and hydroxylation of magnet alloy particles are difficult to proceed at least around the presence of neodymium oxyfluoride and corrosion resistance of the rare earth magnet material can be improved. Furthermore, in the rare earth magnet material according to the present invention, since neodymium oxyfluoride is distributed over the entire rare earth magnet material, corrosion resistance is exhibited by the entire rare earth magnet material and a rare earth magnet having a superior demagnetization resistance to those of conventional ones can be obtained.

(4) Moreover, it has also been clarified that when the present invention is to sinter a compact comprising a powder mixture of magnet powder including Nd as a main component of R1 (NdFeB powder) and neodymium fluoride powder, a rare earth magnet material having a higher density can be obtained than in cases where other powder mixtures are used. The reason and mechanism are not fully clear, either, but at present are assumed as follows.

That is to say, sintering of NdFeB powder proceeds with melting of an Nd-rich phase located in a grain boundary phase. In this case, generally sintering proceeds while absorbed oxygen or oxides on surfaces of magnet alloy particles (or crystal grains) are reduced by Nd present in the grain boundary phase. Therefore, although the original function of Nd is to promote sintering, Nd is consumed for generating oxides and this amount is subtracted from Nd to be used for promoting sintering, so sintering ability of NdFeB powder can be lowered.

Herein, when neodymium fluoride powder is present in NdFeB powder, O atoms in the NdFeB powder are trapped in the form of neodymium oxyfluoride as mentioned above, and Nd necessary for generating the neodymium oxyfluoride is supplied from neodymium fluoride powder. Therefore, Nd, which is effective to promote sintering, is suppressed from being wastefully consumed for generating oxides. It is believed that when a compact of a powder mixture in which neodymium fluoride powder is mixed in NdFeB powder is sintered, Nd in the grain boundary phase tends to more effectively act on promotion of sintering and sintering ability improves when compared to when a compact not containing neodymium fluoride powder or a compact in which powder of a fluoride of a rare earth element other than Nd is mixed is sintered, and as a result, a sintered rare earth magnet having a high density is obtained.

<Rare Earth Magnet Material>

The present invention can be grasped not only as the abovementioned production method but also as a rare earth magnet material obtained by the production method.

(1) More specifically speaking, the present invention can also be grasped as a rare earth magnet material, comprising a lump magnet body in which magnet alloy particles comprising R1 which is one or more rare earth elements, B and the remainder being Fe and inevitable impurities with or without a reforming element are bonded or held in close contact with each other; and dispersed particles comprising neodymium oxyfluoride, which is a compound of Nd, O and F, and is dispersed over all parts including not only a surface part but also an inner part of the magnet body.

(2) When a diffusing element such as Dy and Tb which is different from R1 as a main component of a rare earth magnet material is diffused into the rare earth magnet material, the diffusing element-rich portions in which the diffusing element is concentrated can be formed in at least part of outer peripheries of magnet alloy particles. Since the diffusing element-rich portions are formed also in an inner part of the rare earth magnet material, coercivity of the rare earth magnet material can be improved as a whole.

"The diffusing element-rich portions" mentioned herein can be those formed in outer peripheries of magnet alloy particles constituting magnet powder or those formed at outer peripheries of crystal grains constituting magnet alloy particles. It is believed that an improvement in coercivity due to grain boundary diffusion or the like is caused by repair of reversed magnetic domains formed in crystal grain boundaries. However, since "boundaries" of particles constituting magnet powder are also "boundaries" of crystal grains constituting the particles, it is difficult to distinguish these two kinds of boundaries from each other. Therefore, "grain boundaries" or "boundaries" as used herein include both "grain boundaries" or "boundaries" of particles constituting magnet powder and "grain boundaries" or "boundaries" of crystal grains constituting magnet alloy particles, unless otherwise specified.

(3) Moreover, when the abovementioned magnet alloy particles are NdFeB particles containing Nd as a main component of R1, a sintered rare earth magnet having a higher density than conventional ones can be obtained.

<Others>

The rare earth elements (R) as used herein include scandium (Sc), yttrium (Y), and lanthanoid. Lanthanoid includes lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), lutetium (Lu) and so on. Especially Pr, Nd, Sm, Gd, Tb, Dy and the like are preferred as R.

The first rare earth element (R1), the second rare earth element (R2), or the third rare earth element (R3) as used herein is a rare earth element arbitrarily selected from the abovementioned R and can be either one kind of rare earth element or a group of rare earth elements comprising two or more rare earth elements. For example, a main component of R1 is preferably Nd, but R1 may contain Dy, Tb or the like, which is effective in improving coercivity, together with Nd.

Each of R1, R2 and R3 can be the same or a different rare earth element. As is often the case, however, R3 as a diffusing element is different from R1 as a main component of magnet powder (magnet alloy particles).

(2) The reforming element as used herein is at least one element of cobalt (Co) and lanthanum (La), which improve heat resistance of the rare earth magnet material, and gallium (Ga), niobium (Nb), aluminum (Al), silicon (Si), titanium (Ti), vanadium (V), chromium (Cr), manganese (Mn), nickel (Ni), copper (Cu), germanium (Ge), zirconium (Zr), molybdenum (Mo), indium (In), tin (Sn), hafnium (Hf), tantalum (Ta), tungsten (W) and lead (Pb), which are effective in improving magnetic properties such as coercivity. These reforming elements can be combined arbitrarily. The content of the reforming element is generally very small and, for example, it is preferable that the content is about 0.01 to 10% by mass.

The inevitable impurities are impurities which are contained originally in magnet powder and fluoride powder or mixed in each step, and which are difficult to be removed for cost or technical reasons. Examples of such inevitable impurities include oxygen (O), nitrogen (N), carbon (C), hydrogen (H), calcium (Ca), sodium (Na), potassium (K), and argon (Ar). It should be noted that the above description about reforming elements and inevitable impurities appropriately also applies to a raw material as a supply source of a diffusing element, in addition to fluoride powder.

(3) "The rare earth magnet material" as used in the present invention includes a rare earth magnet raw material and a rare earth magnet member and is not limited in its form. Specifically, the rare earth magnet material can be a bulk material before compacting or processing, or a rare earth magnet having a final product shape or a shape close to it. Besides, the rare earth magnet material is not limited to a sintered magnet material. Moreover, the rare earth magnet material need not to have a block shape and can have a thin film shape, for instance.

(4) A range "x to y" as used herein includes a lower limit value x and an upper limit value y, unless otherwise specified. Moreover, a range such as "a to b" can be formed by arbitrarily combining various lower limit values and upper limit values recited herein. Furthermore, any given numerical value contained in the ranges recited herein can be used as an upper limit value or a lower limit value for defining a numerical value range.

DESCRIPTION OF EMBODIMENTS

Figure 1A:
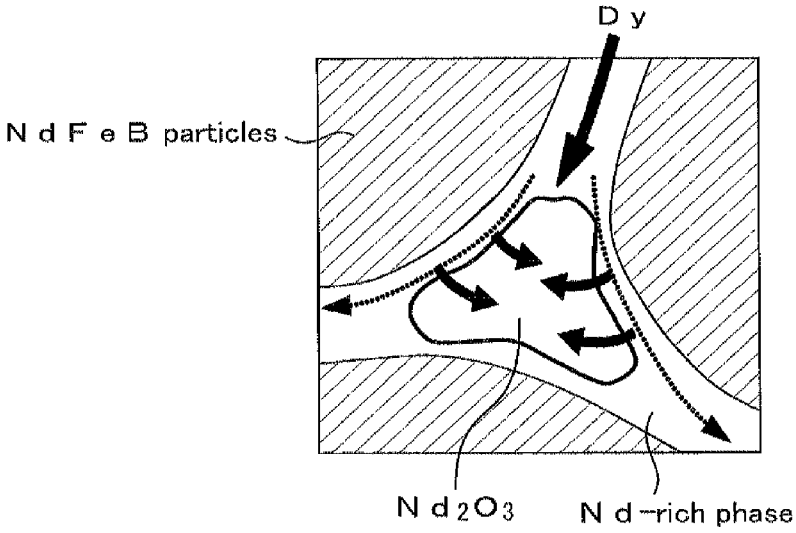
FIG. 1A is a schematic view showing how Dy diffuses in a conventional NdFeB magnet which does not contain fluoride powder.

The present invention will be described in more detail by way of embodiments of the invention. It should be noted that what is explained in the present description including those of the following embodiments is appropriately applied not only to a production method but also a rare earth magnet material according to the present invention. One or more constituent features arbitrarily selected from the constitution described below can be added to the abovementioned constitution of the present invention. Constitution of a production method can be constitution of a rare earth magnet material, when it is understood as a product by process. Which embodiment is best varies with target application, required performance and the like.

<Method for Producing Rare Earth Magnet Material>

(1) Preparation Step

A preparation step is a step of preparing a powder mixture by mixing magnet powder, which is powder of a magnet alloy, and fluoride powder, which is powder of a fluoride, at least one of these powders containing Nd. Mixing of these two powders is preferably carried out by mixing them in an oxidation-preventing atmosphere until the entire mixture becomes uniform by using a ball mill, a V-type mixer, a Henschel mixer, an automated mortar, a Spartan Granulator (a high-speed mixing machine) or the like. Uniform mixing makes it easy to obtain a rare earth magnet material in which a diffusing element is to be uniformly dispersed. Moreover, it is also effective to mix fluoride powder before producing magnet alloy powder and pulverize both powders simultaneously to prepare a powder mixture.

(2) Magnet Powder

Magnet powder is powder of a magnet alloy comprising R1 which is one or more rare earth elements, B, and the remainder being Fe and inevitable impurities and, if necessary, one or more reforming elements. The magnet alloy is typically a R1-Fe—B alloy which can constitute $R1_2Fe_{14}B$ as a main phase. However, it is preferable that the magnet alloy has a composition which allows formation of a R1-rich phase effective in improving coercivity and sintering ability of a rare earth magnet material rather than a theoretical composition based on $R1_2Fe_{14}B$. Therefore, it is preferable that the R1-Fe—B magnet alloy comprises 10 to 30 atomic % R1, 1 to 20 atomic % B, and the remainder being Fe relative to 100 atomic % of the total magnet alloy. An excessively small or large amount of any of the elements affects the volume ratio of the $R1_2Fe_{14}B_1$ phase (2-14-1 phase) as a main phase, which results in deterioration of magnetic properties and lowering of sintering ability. A lower limit value or an upper limit value of R1 or B can be arbitrarily selected within the above ranges and set. However, especially in a case of obtaining a sintered rare earth magnet, when R1 is 12 to 16 atomic % and B is 5 to 12 atomic %, a highly dense rare earth magnet having good magnetic properties is easily obtained. Moreover, although Fe is basically a main component of the remainder, if it has to be said, it is preferable that Fe is 72 to 83 atomic %. However, the content of Fe being the remainder other than R1 and B can vary with the ratio of an element effective to improve various properties of a rare earth magnet (a reforming element) and inevitable impurities. It should be noted that carbon (c) can be used in place of B, and in this case it is preferable to adjust the sum of B and C to 5 to 12 atomic %.

Especially in obtaining a sintered rare earth magnet containing Nd as a main component of R1, it is preferable that magnet powder or a rare earth magnet material is constituted by NdFeB particles containing 27 to 35% by mass of Nd and 0.8 to 1.5% by mass of B relative to 100% by mass of the total magnet powder or rare earth magnet material.

The magnet powder is not limited in its production method or form. The magnet powder can be what is obtained by applying mechanical pulverization or hydrogen decrepitation to a cast magnet alloy of a desired composition. Moreover, the magnet powder can be cast pieces having a thin plate shape obtained by rapidly solidifying a magnet alloy by strip casting or the like, what is produced by way of hydrogen treatment such as HDDR (Hydrogenation-Disproportionation-Desorption-Recombination method), ultrarapidly cooled ribbon particles, or films formed by sputtering or the like. Moreover, each particle of magnet powder (each particle of a magnet alloy) does not have to be constituted by distinct crystal grains, that is to say, can be amorphous.

Although the particle diameter of the magnet powder is not limited, either, preferably the mean particle diameter (particle diameter at a cumulative mass of 50% or Median diameter) is about 1 to 20 μm or about 3 to 10 μm. An excessively small or large mean particle diameter is not preferred, because the excessively small mean particle diameter increases costs while the excessively large mean particle diameter causes lowering of density and magnetic properties of a rare earth magnet material, though diffusibility of a diffusing element into an inner part is good.

Magnet powder does not have to comprise one kind of powder in the abovementioned composition or form, and can be a mixture of plural kinds of powders which are different in alloy composition or form such as particle shape and particle diameter.

(3) Fluoride Powder

Any fluoride which reacts with O present in the vicinity of particles of magnet powder to generate neodymium oxyfluoride can serve as fluoride powder. Therefore, the kind of fluorides is not limited and powder comprising a variety of fluorides can be used. Although neodymium oxyfluoride is expressed by $NdO_xF_y$, where x, y are real numbers, especially stable NdOF is preferred among $NdO_xF_y$. Nd in neodymium oxyfluoride is not necessarily contained in a fluoride. That is to say, it is sufficient that Nd is contained in at least one of fluoride powder and magnet powder. Of course, Nd can be contained in both magnet powder and fluoride powder.

A fluoride constituting fluoride powder according to the present invention comprises, for example, at least one of LiF, $MgF_2$, $CaF_2$, $ScF_3$, $VF_2$, $VF_3$, $CrF_2$, $CrF_3$, $MnF_2$, $MnF_3$, $FeF_2$, $FeF_3$, $CoF_2$, $CoF_3$, $NiF_2$, $ZnF_2$, $AlF_3$, $GaF_3$, $SrF_2$, $YF_3$, $ZrF_3$, $NbF_5$, AgF, $InF_3$, $SnF_2$, $SnF_4$, $BaF_2$, $LaF_2$, $LaF_3$, $CeF_2$, $CeF_3$, $PrF_2$, $PrF_3$, $NdF_2$, $NdF_3$, $SmF_2$, $SmF_3$, $EuF_2$, $EuF_3$, $GdF_3$, $TbF_3$, $TbF_4$, $DyF_2$, $DyF_3$, $HoF_2$, $HoF_3$, $ErF_2$, $ErF_3$, $TmF_2$, $TmF_3$, $YbF_3$, $YbF_2$, $LuF_2$, $LuF_3$, $PbF_2$, $BiF_3$, $LaF_2$, $LaF_3$, $CeF_2$, $CeF_3$, $GdF_3$, and the like. The fluoride can be an oxyfluoride formed by bonding of at least one kind of these fluorides and oxygen. The fluoride powder can be either powder of a single kind of fluoride or a powder mixture of two or more kinds of fluorides.

In general, however, a metal element to be bonded with F in a fluoride is to remain in a rare earth magnet material. Such a metal element is preferably an element which gives as little harmful effects as possible on magnetic properties of a rare earth magnet to be obtained as a final product, or more preferably an element which can improve the magnetic properties. Therefore, the fluoride powder of the present invention is preferably rare earth fluoride powder comprising a compound of F and a second rare earth element (R2) which is one or more rare earth elements such as La, Ce, Pr, Nd, Dy and Tb. It is especially preferable that R2 is Dy or Tb, because coercivity of a rare earth magnet material can be simultaneously improved.

The particle diameter of fluoride powder is not limited, but as the diameter is smaller, dispersibility is better. Therefore, it is preferable that fluoride powder as primary particles has a mean particle diameter (a particle diameter at 50% of accumulative mass or Median diameter) of about 0.01 to 20 μm, or 0.1 to 10 μm. However, powder on market is sometimes agglomerated. In this case, it is preferable that fluoride powder as secondary particles has a mean particle diameter (a particle diameter at 50% of accumulative mass or Median diameter) of about 1 to 100 μm or 1 to 10 μm. An excessively small or large mean diameter is not preferred, because the excessively small mean diameter increases costs while the excessively large mean diameter causes poor dispersibility in a powder mixture and accordingly causes poor diffusibility of a diffusing element. It should be noted that fluoride powder can be used in the form of slurry.

Moreover, fluoride powder can be nanoparticles produced or prepared by chemical synthesis and preferably the mean particle diameter is 1 to 200 nm or 1 to 50 nm. Fluoride powder comprising nanoparticles is used, for example, in the form of paste.

An excessively small or large ratio of fluoride powder to the total powder mixture is not preferred, because the excessively small ratio causes insufficient trapping of O by fluoride powder while the excessively large ratio causes lowering of magnetic properties of a rare earth magnet material. Therefore, in the preparation step, it is preferable that the amount of fluoride powder to be mixed is adjusted in accordance with a possible amount of O atoms to be enclosed in a powder mixture (or a compact) to be subjected to the heating step. That is to say, it is preferable that fluoride is added in an amount necessary to catch O to be enclosed, in the form of stable neodymium oxyfluoride. For example, when $Nd_2O_3$ formed on a surface or an inner part of magnet alloy particles is to be changed into NdOF by using $NdF_3$ powder, since $Nd_2O_3+NdF_3 \rightarrow 3NdOF$, $NdF_3$ powder can be mixed in about the same mole ratio as that of $Nd_2O_3$. Taking a possible amount of O to be generally mixed into account, it is preferable that the ratio of fluoride powder to be mixed in magnet powder relative to 100 atomic % of the total powder mixture is 0.1 to 10 atomic % or 0.1 to 5 atomic %, in other words, 0.05 to 5% by mass.

(4) Heating Step

The heating step is a step of causing O in the vicinity of particles of the magnet powder and a fluoride to react and generate neodymium oxyfluoride, thereby obtaining a lump rare earth magnet material in which neodymium oxyfluoride is distributed over all parts including not only a surface part but also an inner part thereof.

Heating form, heating temperature and the like can be arbitrarily controlled within a range in which the above neodymium oxyfluoride is generated in the almost uniformly mixed powder and O in grain boundaries or the like is trapped. For example, heating temperature cannot necessarily be specified because it also depends on the composition of magnet powder or fluoride powder or the like. However, in a case of using rare earth fluoride powder, preferably the heating temperature is 300 to 1,200 deg. C. or 800 to 1,100 deg. C. An excessively low temperature makes it difficult to form neodymium oxyfluoride, while an excessively high temperature is not favorable in terms of heating efficiency or magnetic properties.

When a sintered rare earth magnet is produced, the heating step can be a sintering step for obtaining a sintered body of a compact of a powder mixture, and preferably the sintering temperature is 700 to 1,150 or 900 to 1,100 deg. C. An excessively low sintering temperature decreases sintering efficiency, while an excessively high sintering temperature causes defects such as melting and is not favorable in terms of heating efficiency or magnetic properties.

(5) Diffusing Step

The diffusing step is a step of diffusing a diffusing element into a rare earth magnet material after the above heating step (or the sintering step). Preferably the diffusing element is a third rare earth element (R3) which is one or more rare earth elements. Specifically, Dy, Tb, or the like, which improves coercivity of a rare earth magnet material, is preferred.

It is to be noted that diffusion includes grain boundary diffusion, which is diffusion along grain boundaries of magnet powder particles or crystal grains, and internal diffusion (volume diffusion), which is diffusion into their inner parts by solid solution or the like. Grain boundary diffusion is preferred in view of efficiently improving magnetic properties such as coercivity while reducing the amount of a scarce diffusing element used. In the diffusing step according to the present invention, grain boundary diffusion is performed very efficiently. That is to say, diffusion efficiency calculated by [(coercivity after diffusion of a diffusing element)−(coercivity before diffusion of the diffusing element)]/(the amount of the diffusing element diffused) is very high.

Specifically, in a case of the rare earth magnet material according to the present invention, diffusion efficiency is as high as 20 to 60 (kOe/% by mass) or 1,590 to 4,770 ($kAm^{-1}$/% by mass).

The method for carrying out the diffusing step is not limited. For example, the diffusing step can be carried out by vapor deposition method in which sputtering or the like is performed using a diffusant raw material such as metal Dy as a target, vapor method in which a rare earth magnet material and a diffusant raw material located in the vicinity of the rare earth magnet material are heated in a furnace to directly expose the rare earth magnet material to vapor of a diffusing element, coating method in which fluoride powder is coated on a surface of a rare earth magnet material and heated as disclosed in PTL 2, and a method of coating a slurry of a fluoride and heating, or the like.

<Mechanism>

(1) Mechanism of Generating Neodymium Oxyfluoride

On the basis of the abovementioned, mechanism of forming neodymium oxyfluoride (NdOF) will be described taking, as an example, a case of producing a rare earth magnet material using a powder mixture of NdFeB powder (magnet powder) and $(R2)F_3$ powder (fluoride powder).

An Nd-rich phase and oxides ($Nd_2O_3$, $NdO_x$) formed by mixed O can be present in grain boundaries of a rare earth magnet material constituted by NdFeB powder. When particles of $(R2)F_3$ powder are present in the vicinity of the grain boundaries, the following reaction generates NdOF and liberates R2.

$$(R2)F_3+Nd_2O_3+Nd \rightarrow 3NdOF+R2 \quad \text{(Reaction Formula 1)}$$

When the $(R2)F_3$ powder is $NdF_3$ powder (i.e., R2=Nd) the following reaction occurs to generate NdOF, without liberating R2=Nd, that is to say, without consuming Nd from the Nd-rich phase in grain boundaries.

$$NdF_3+Nd_2O_3 \rightarrow 3NdOF \quad \text{(Reaction Formula 2)}$$

Considering now a case of sintering magnet powder, generally sintering proceeds while adsorbed oxygen and oxides in grain boundaries are reduced by Nd in the grain boundary phase. Therefore, Nd in the grain boundary phase can be consumed in an amount corresponding to the amount of O in presence and the amount of Nd contributing to sintering ability can be decreased.

However, when $(R2)F_3$ powder is present in magnet powder, O is trapped by F and fixed in the form of NdOF. Especially when $(R2)F_3$ powder is $NdF_3$ powder, Nd in the grain boundary phase is not consumed for generating NdOF.

As a result, when $NdF_3$ powder is used as fluoride powder, sintering ability is greatly improved and a sintered rare earth magnet having a sufficiently high density can be obtained even at a relatively low sintering temperature.

It should be noted that R2 (e.g., Dy or Tb) which is liberated when $(R2)F_3$ power is not $NdF_3$ powder is also solid-solved in $R1(Nd)_2Fe_{14}B$ as a main phase and contributes to an improvement in coercivity of a rare earth magnet material.

(2) Diffusion Mechanism

Diffusion mechanism will be described taking, as an example, a case in which a diffusing element, Dy, diffuses into a rare earth magnet material comprising NdFeB powder.

First, when diffusion treatment is applied to a conventional rare earth magnet material comprising magnet powder which does not contain fluoride powder, Dy makes, for example, the following reaction with oxides ($Nd_2O_3$, $NdO_x$) or the like present in grain boundaries.

$$2Dy+Nd_2O_3 \rightarrow Dy_2O_3+2Nd \quad \text{(Reaction Formula 3)}$$

Therefore, the purposefully introduced diffusing element (Dy) is changed into an oxide on the way of diffusion and trapped at grain boundary triple junctions or the like, so the diffusing element does not contribute to magnetic domain wall displacement or suppression of reversed magnetic domain formation at boundaries and cannot effectively improve coercivity of a rare earth magnet material. That is to say, the diffusing element is wasted and especially coercivity of an inner part of the rare earth magnet material cannot be improved. This state is schematically shown in FIG. 1A.

Figure 1B:
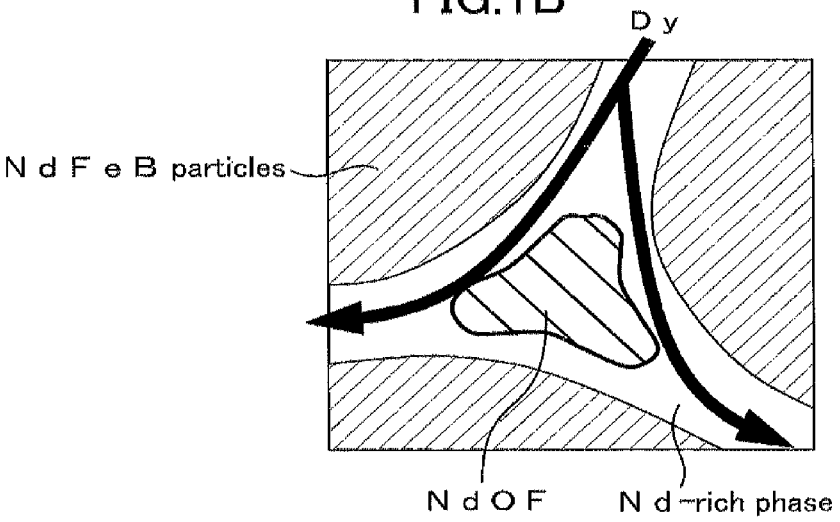
FIG. 1B is a schematic view showing how Dy diffuses in an NdFeB magnet of the present invention which contains fluoride powder.

On the other hand, in the present invention, since O in a rare earth magnet material is trapped beforehand by NdOF, which is stabler than $Dy_2O_3$ or the like, Dy is suppressed from being trapped at grain boundary triple junctions or the like on the way of diffusion and can smoothly diffuse into the rare earth magnet material. This state is schematically shown in FIG. 1B.

Thus, according to the present invention, Dy smoothly diffuses along the grain boundary phase of magnet alloy particles or their crystal grains so as to surround the boundaries of the main phase, and remarkably reduces starting points which lead to a decrease in coercivity. Thus, a rare earth magnet material having a greatly improved coercivity can be efficiently obtained.

By the way, when the fluoride powder according to the present invention comprises a fluoride of a diffusing element (e.g., $DyF_3$, $TbF_3$), the diffusing element (e.g., Dy, Tb) can be liberated in the heating step as shown in the above reaction formula 1. The liberated diffusing element can be solid-solved into magnet alloy particles ahead of the diffusing step. Therefore, the diffusing element separately introduced in the subsequent diffusing step is difficult to be solid-solved in the magnet alloy particles anymore and grain boundary diffusion tends to proceed more preferentially. That is to say, while suppressing the amount of the diffusing element used, coercivity of a rare earth magnet material can be efficiently enhanced.

<Use Application of Rare Earth Magnet Material>

The rare earth magnet material of the present invention can be a raw material, a rare earth magnet as a final product or a rare earth magnet close to it. Use application and form of the rare earth magnet are not limited. The rare earth magnet material of the present invention can be used, for example, in a variety of electromagnetic devices such as rotors and stators of electric motors, magnetic recording media such as magnetic disks, linear actuators, linear motors, servo motors, speakers, electric generators and so on.

EXAMPLES

The present invention will be described more specifically by way of examples.

Example 1

Relation Between Coercivity and the Amount of a Diffusing Element (1) The relation between coercivity of a sintered rare earth magnet (a rare earth magnet material) and the amount of a diffusing element (R3) diffused was preliminarily examined. Specimens used for this experiment were produced in the following way.

First, an Fe-31.5% Nd-1% B-1% Co-0.2% Cu (unit: % by mass) magnet alloy was cast. This magnet alloy was subjected to hydrogen decrepitation and then further pulverized by a jet mill, thereby obtaining magnet powder having a mean particle diameter D50 (Median diameter) of 6 μm. The pulverization by the jet mill was performed in a nitrogen atmosphere.

This magnet powder was compacted in a rectangular parallelepiped shape with dimensions 20×15×10 mm in a magnetic field (a compacting step). The applied magnetic field was 2T. The thus obtained compacts were heated in a vacuum atmosphere of up to $10^{-3}$ Pa at 1,050 deg. C. for 4 hours, thereby obtaining sintered bodies (a sintering step). After surfaces of the sintered bodies were polished, Dy diffusion treatment was applied to the polished surfaces (a diffusing step).

This diffusion treatment were carried out by heating the sintered bodies and Dy as a simple substance (metal Dy) located at a distance of about 10 mm from each other in a vessel (a heating furnace) in a vacuum atmosphere of $10^{-4}$ Pa at 750 to 850 deg. C. for 16 to 128 hours. The amount of Dy diffused was adjusted by controlling the heating temperature and the heating time.

Moreover, heating was applied to the sintered bodies after this diffusion treatment in a vacuum atmosphere of $10^{-2}$ Pa at 480 deg. C. for one hour (homogenization treatment, aging treatment)

(2) For the obtained various kinds of specimens, coercivity was measured by using a pulsed high field magnetometer. Moreover, the amounts of Dy diffused in the respective specimens were measured by an electron probe microanalyzer (EPMA) and by high frequency inductively coupled plasma mass spectrometry (ICP). The measurement results thus obtained are summarized in FIG. 2. Note that the dashed line shown in FIG. 2 indicates results of conventional specimens producing by using a cast alloy which contained Dy from the beginning.

Figure 2:
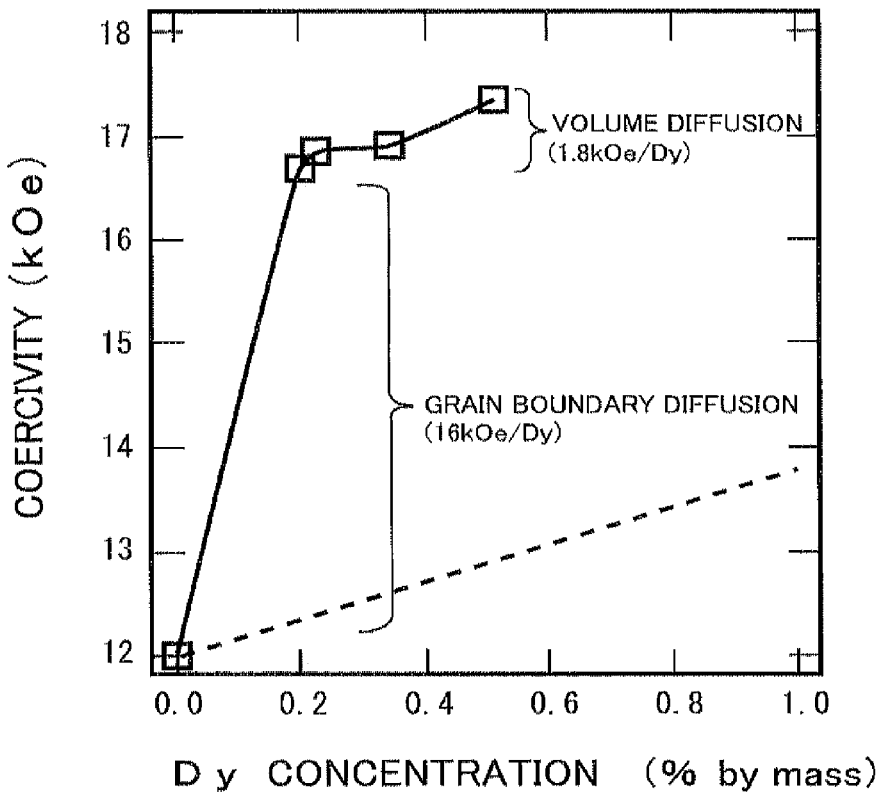
FIG. 2 is a graph showing a relation between the concentration of Dy diffused into a rare earth magnet and its coercivity.

(3) It is apparent from the results of FIG. 2 that coercivity improves with an increase in Dy concentration, and that coercivity is rapidly increased especially by grain boundary diffusion. It is also apparent that when the increase in coercivity by grain boundary diffusion is saturated, diffusion shifts to volume diffusion in which Dy diffuses into an inside of magnet alloy particles by solid solution or the like. Moreover, it is also apparent that an improvement in coercivity in this case is about as slow as an increase in coercivity in a case using alloyed Dy.

Example 2

Effect of Fluoride Powder on Coercivity (1) Powder mixtures in which fluoride powders were mixed in magnet powder were prepared. Diffusion treatment was applied to sintered rare earth magnets (rare earth magnet materials) obtained by sintering compacts of the powder mixtures and then coercivity was measured. Specifically, the following specimens were prepared and evaluated.

Various kinds of fluoride powders were mixed in the magnet powder having the same composition as that of Example 1 (Fe-31.5% Nd-1% B-1% Co-0.2% Cu) (a preparation step). All the prepared fluoride powders were rare earth fluoride powers: $NdF_3$ power, $DyF_3$ powder and $TbF_3$ powder. The amount of each of the fluoride powders mixed was 1.5% by mass relative to the total powder mixture (100% by mass). The fluoride powders all had a mean particle diameter D50 (Median diameter) of 10 μm.

The various kinds of powder mixtures were compacted in a magnetic field and sintered under the same conditions as in Example (a heating step, a sintering step). Furthermore, diffusion treatment and homogenization treatment similar to those of Example 1 were applied to the thus obtained sintered bodies. Heating temperature and heating time for the diffusion treatment of the respective specimens are shown in Table 1.

(2) For the thus obtained various kinds of specimens (the rare earth magnet materials), coercivity and the amount of Dy diffused were measured in a similar method to the above (Specimen Nos. A11 to A15).

Moreover, sintered rare earth magnets produced without mixing fluoride powder were prepared as comparative specimens. For one of the comparative specimens, first, coercivity before diffusion treatment was measured (Specimen No. A41). For some of the other comparative specimens, coercivity and the amount of Dy diffused after the abovementioned diffusion treatment were measured (Specimen Nos. A21 to A26).

Additionally, $DyF_3$ powder or $TbF_3$ powder was coated on polished surfaces of some of the sintered rare earth magnets produced without mixing fluoride powder to diffuse Dy or Tb, and coercivity and the amount of Dy diffused were measured (Specimen Nos. A31 to A34 and Specimen Nos. A35 to A37). This diffusion treatment by coating (coating diffusion) was carried out by coating each of the sintered rare earth magnets with a slurry in which $DyF_3$ powder or $TbF_3$ powder of 10 μm was dispersed in alcohol and heating the coated sintered rare earth magnets in a vacuum of $10^{-1}$ Pa. The ratio of coating was 0.2 parts by mass relative to 100 parts by mass of each of the sintered rare earth magnets. Heating temperature and heating time are shown in Table 1.

Figure 3A:
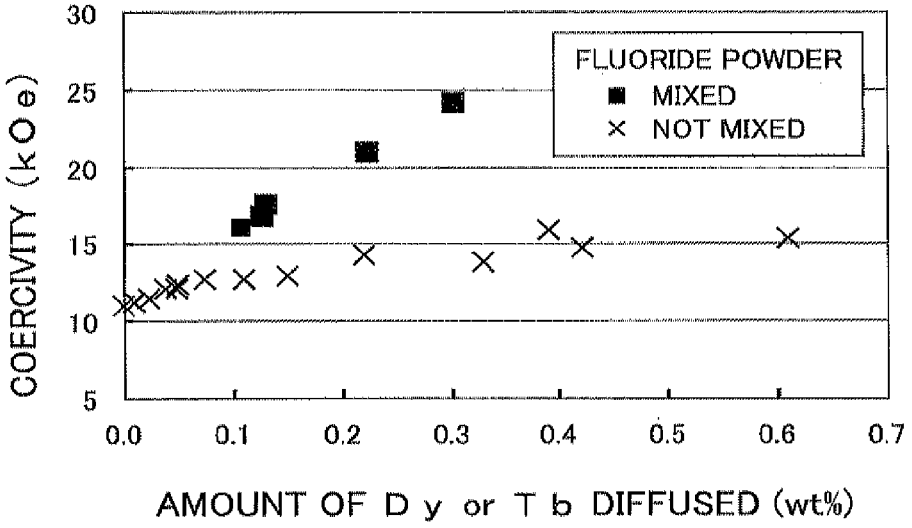
FIG. 3A is a dispersion diagram showing effect of the amount of Dy or Tb diffused on different kinds of sintered rare earth magnets, and specifically showing a relation between the amount of Dy or Tb diffused and coercivity.
Figure 3B:
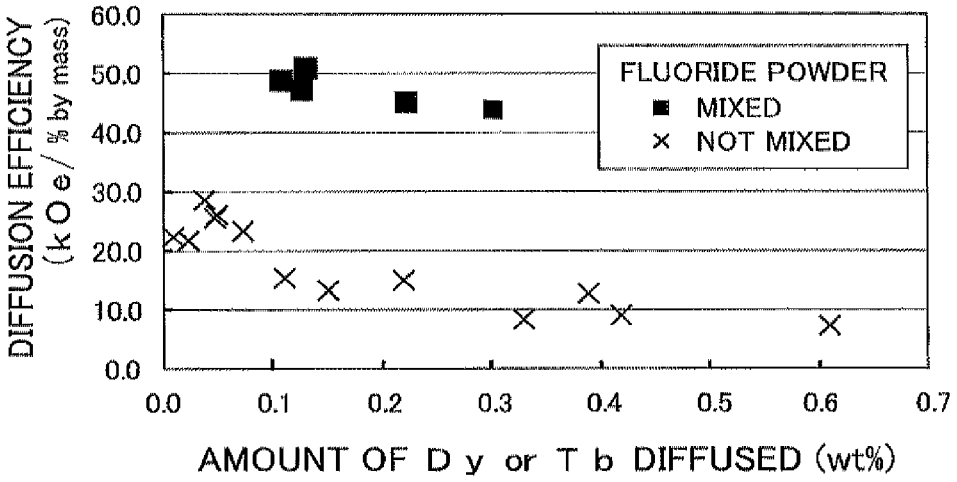
FIG. 3B is a dispersion diagram showing effect of the amount of Dy or Tb diffused on different kinds of sintered rare earth magnets, and specifically showing a relation between the amount of Dy or Tb diffused and diffusion efficiency.

The measurement results thus obtained are also shown in Table 1. Diffusion efficiency in Table 1 was calculated by [(coercivity after Dy diffusion)−(coercivity before Dy diffusion)]/(the amount of Dy diffused). The results of Table 1 are also shown in dispersion diagrams of FIGS. 3A and 3B (these two are appropriately referred to as "FIG. 3"). In FIG. 3, ■ indicates the specimens produced with mixing fluoride powder in magnet powder, while X indicates the specimens produced without mixing fluoride powder.

(3) As apparent from Table 1 and FIG. 3, when diffusion treatment conditions were on the same level, the amount of Dy or Tb diffused increased about two to three times in the specimens produced with mixing fluoride powder in magnet powder when compared to the specimens produced without mixing fluoride powder. Coercivity also increased approximately in proportion to the increase in the amount.

On the other hand, in the specimens produced without mixing fluoride powder in magnet powder, coercivity did not increase much in spite of an increase in the amount of Dy or Tb diffused. This tendency was similarly observed in the specimens obtained by diffusing Dy by vapor method (Specimen Nos. A21 to A26) and in the specimens obtained by diffusing Dy or Tb by coating $DyF_3$ powder or $TbF_3$ powder (Specimen Nos. A31 to A37) This is assumed to be because when fluoride powder is not mixed in magnet powder, Dy or Tb diffusion is limited to surface parts of sintered rare earth magnets. These are also apparent from diffusion efficiency shown in Table 1 and FIG. 3B.

Example 3

Figure 4:
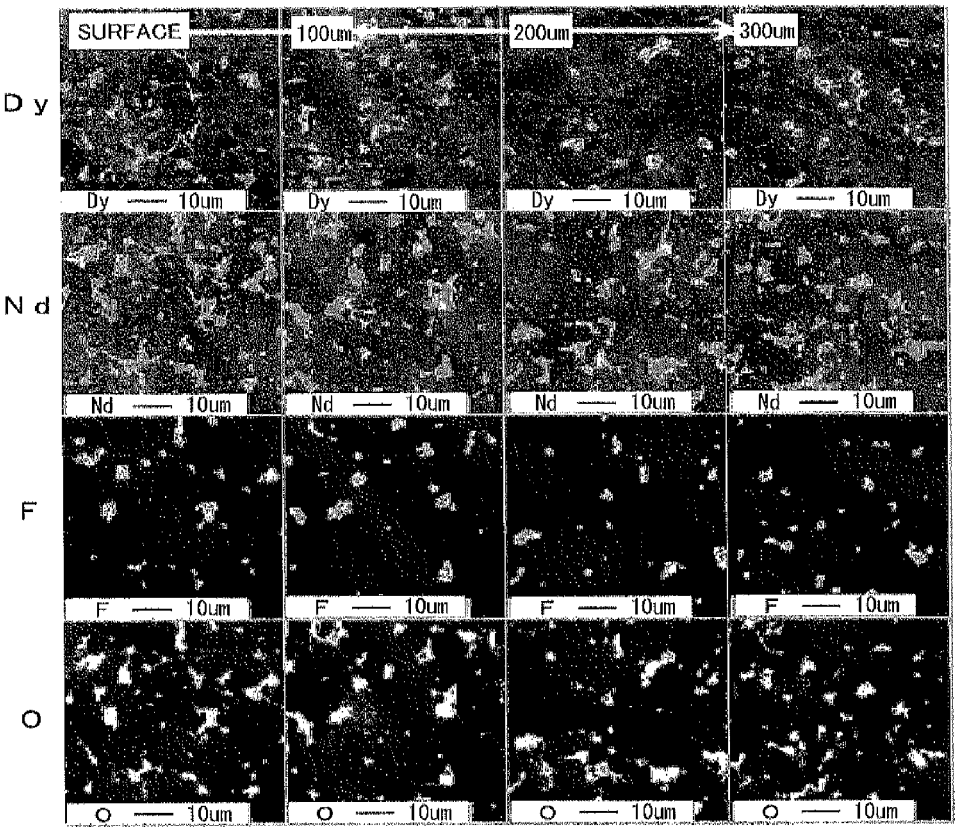
FIG. 4 is a photograph showing EPMA images of respective elements of a sintered rare earth magnet produced with mixing $NdF_3$ powder in ascending order of distance from a surface.
Figure 5:
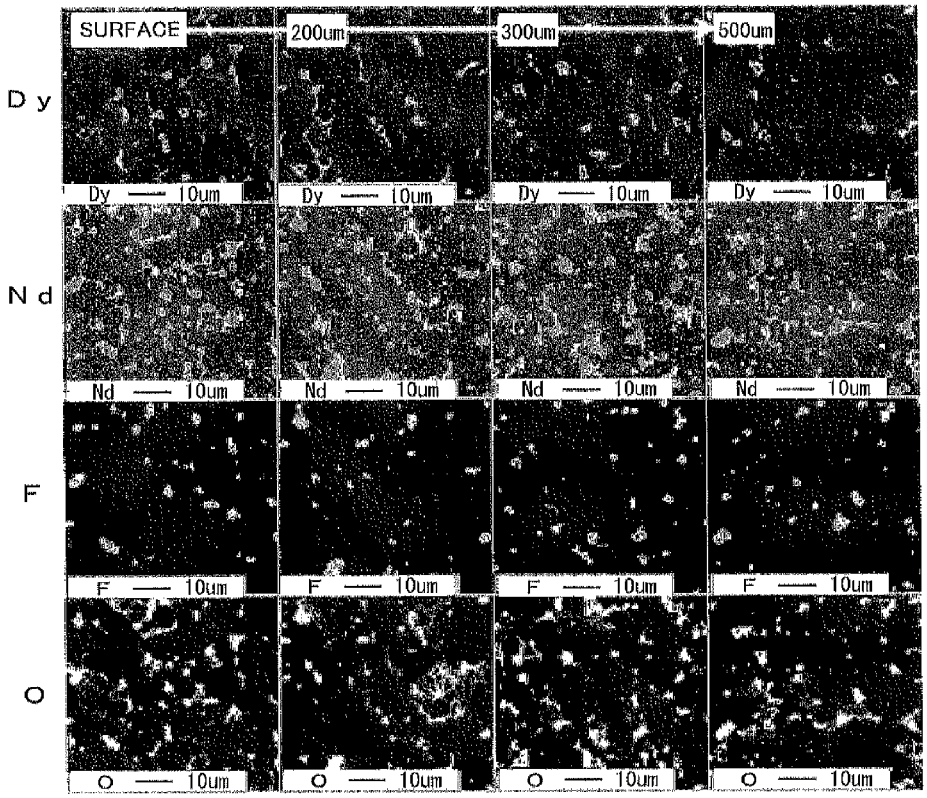
FIG. 5 is a photograph showing EPMA images of respective elements of a sintered rare earth magnet produced with mixing $DyF_3$ powder in ascending order of distance from a surface.
Figure 6:
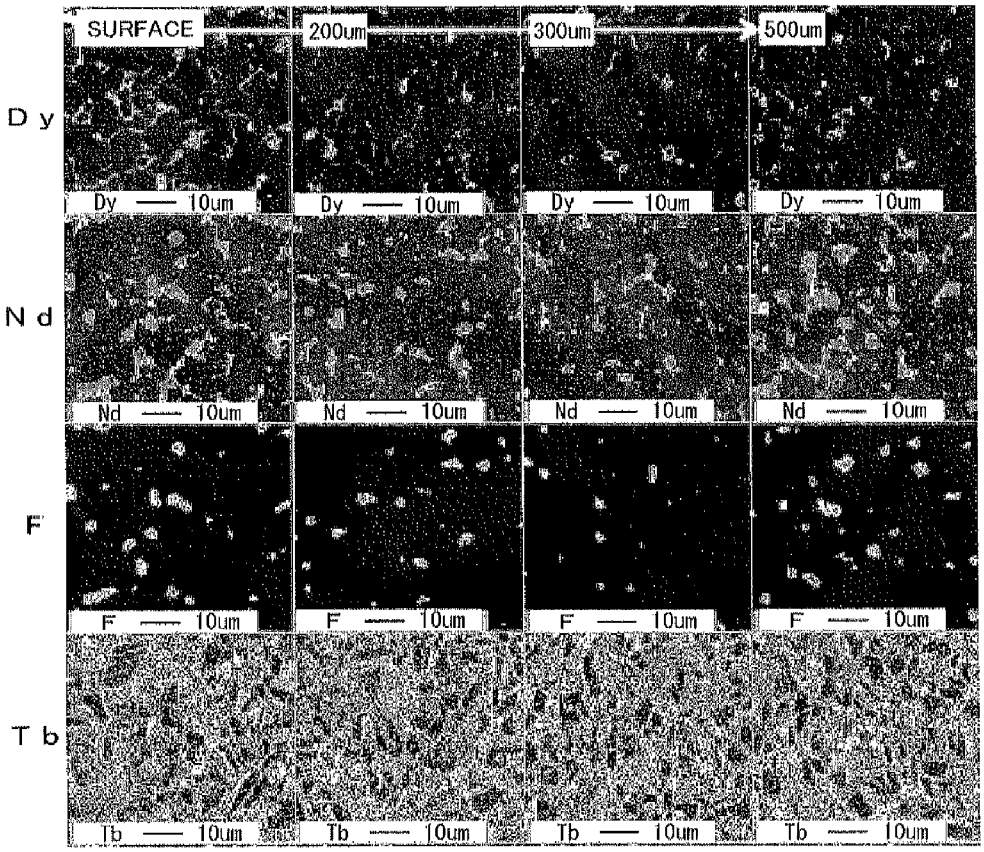
FIG. 6 is a photograph showing EPMA images of respective elements of a sintered rare earth magnet produced with mixing $TbF_3$ powder in ascending order of distance from a surface.

Effect of Fluoride Powder on Diffusion Pattern (1) Respective specimens were produced by changing the amount of fluoride powder mixed shown in Example 2 from 0.9% by mass to 3% by mass, and their EPMA images were observed. The results are shown in FIG. 4 to FIG. 6. Furthermore, EPMA images of a specimen produced without mixing fluoride powder in magnet powder is shown in FIG. 7 and an enlarged one of the EPMA images of Dy at a depth of 300 μm from a surface is shown in FIG. 8.

(2) It is apparent from these images that when fluoride powder was mixed in magnet powder, Dy, which is a diffusing element, diffused sufficiently into an inner part of each of the sintered rare earth magnets regardless of the kind of fluoride powders. Furthermore, it is also apparent from the EPMA images of Nd, F and O that NdOF is approximately uniformly dispersed over all parts including an inner part.

Figure 7:
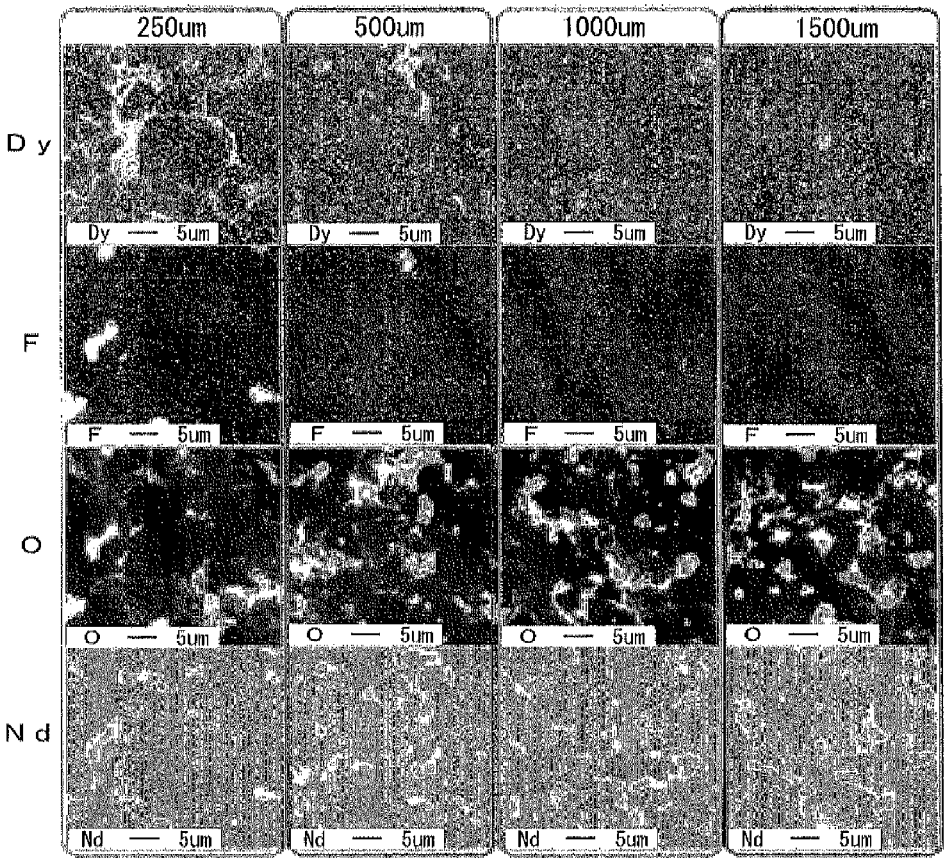
FIG. 7 is a photograph showing EPMA images of respective elements of a sintered rare earth magnet produced without mixing fluoride powder.
Figure 8:
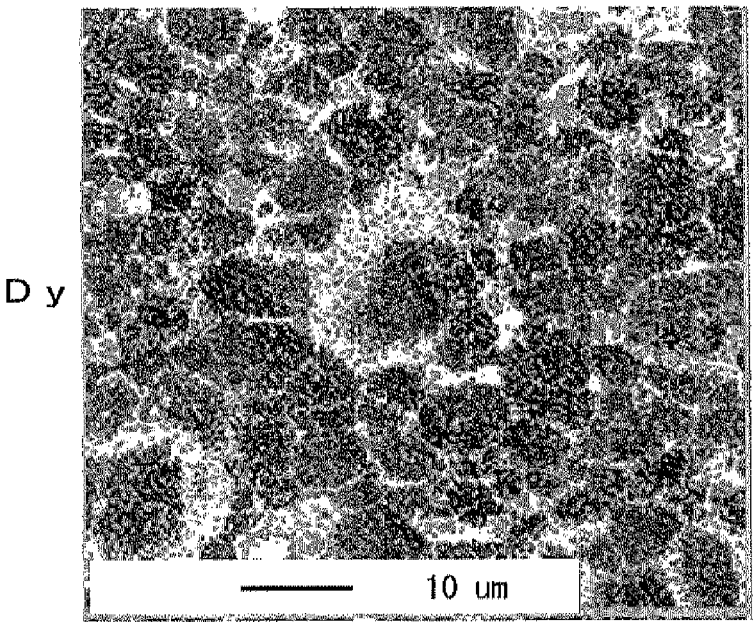
FIG. 8 is an enlarged photograph showing an EPMA image of Dy of the sintered rare earth magnet produced without mixing fluoride powder.

In contrast, it is apparent from FIG. 7 that when fluoride powder was not mixed in magnet powder, Dy is distributed intensively in the vicinity of a surface of the sintered rare earth magnet and didn't diffuse into an inner part thereof. FIG. 8 suggests the cause is that Dy is aggregated in grain boundaries (especially in the vicinity of triple junctions) of magnet alloy particles located in the vicinity of the surface of the sintered rare earth magnet. As apparent from F distribution in the EPMA images of FIG. 7, F was detected only in the surface part and was not detected in the inner part of the sintered rare earth magnet. Accordingly, in sintered rare earth magnets produced without mixing fluoride powder in magnet powder, NdOF is not present in an inner part thereof.

Furthermore, in the specimen produced without mixing fluoride powder in magnet powder, as indicated by FIG. 7, the EPMA images of Nd and those of O are very similar to each other, and it is understood that neodymium oxide (e.g., $Nd_2O_3$) is aggregated in grain boundaries (especially in the vicinity of triple junctions) of magnet alloy particles. In contrast, as apparent from any of FIGS. 4 to 6, in the specimens produced with mixing fluoride powder in magnet powder, such neodymium oxide aggregation is not observed. That is to say, it is obvious from FIGS. 4 to 6 that in spite of the kind of fluoride powders, neodymium oxide (e.g., $Nd_2O_3$) and the like become neodymium oxyfluoride (NdOF) and are stably distributed in sintered rare earth magnets.

Example 4

Effect of Fluoride Powder on Sintering Ability (1) A magnet powder produced similarly to that of Example 1, except for a change in alloy composition (Fe-31.5% Nd-1% B), was prepared. Also prepared as fluoride powder were $LaF_3$ powder, $CeF_3$ powder, $PrF_3$ powder, $NdF_3$ powder, $DyF_3$ powder and $TbF_3$ powder, which are all rare earth fluoride powder. Powder mixtures were prepared by mixing any one of the fluoride powders in the magnet powder relative to 100% by mass of the total powder mixture (a preparation step).

The various kinds of powder mixtures were compacted in a magnetic field of 2T under 50 MPa, thereby obtaining compacts each having a rectangular parallelpiped shape with dimensions 20×15×10 mm. The compacts were heated in a vacuum atmosphere at 1,030 deg. C. for 3 hours, thereby obtaining sintered bodies (Specimen Nos. 51 to 56).

Moreover, as a comparative specimen, a similar sintered body was produced by using magnet powder in which fluoride powder was not mixed (Specimen No. B7).

(2) Density of the obtained various kinds of sintered bodies was measured by Archimedes' method. The results are shown in Table 2.

Density of the sintered bodies produced with mixing $LaF_3$ powder, $DyF_3$ powder or $TbF_3$ powder were lower than that of the sintered body produced without mixing fluoride powder. Density of the sintered bodies produced with mixing $CeF_3$ powder or $PrF_3$ powder were not so different from that of the sintered body produced without mixing fluoride powder.

In contrast, density of the sintered body produced with mixing $NdF_3$ powder was higher than that of any of the other sintered bodies. Therefore, it has become apparent that the use of $NdF_3$ powder as fluoride powder not only promotes internal diffusion of Dy or the like as mentioned above but also improves sintering ability of sintered rare earth magnets and attains density enhancement.

TABLE 1

| SPECIMEN No. | DIFFUSION TREATMENT | FLUORIDE POWDER MIXED IN MAGNET POWDER | HEATING TEMP. (° C.) | TIME (Hr) | AMOUNT OF Dy or Tb DIFFUSED (% by mass) | COERCIVITY HcJ (kOe) | DIFFUSION EFFICIENCY HcJ/Dy AMOUNT (kOe/% by mass) |
|---|---|---|---|---|---|---|---|
| A11 | Dy-VAPOR | $NdF_3$ | 780 | 16 | 0.106 | 16.2 | 49.1 |
| A12 | METHOD | | 810 | 20 | 0.221 | 21.0 | 45.2 |
| A13 | | | 830 | 30 | 0.301 | 24.2 | 43.9 |
| A14 | | $DyF_3$ | 780 | 16 | 0.125 | 16.9 | 47.2 |
| A15 | | $TbF_3$ | 780 | 16 | 0.129 | 17.6 | 51.2 |
| A21 | Dy-VAPOR | — | 760 | 32 | 0.039 | 12.1 | 28.5 |
| A22 | METHOD | | 780 | 16 | 0.047 | 12.2 | 25.5 |
| A23 | | | 810 | 16 | 0.073 | 12.7 | 23.3 |
| A24 | | | 800 | 48 | 0.150 | 13.0 | 13.3 |
| A25 | | | 820 | 128 | 0.420 | 14.8 | 9.0 |
| A26 | | | 840 | 72 | 0.610 | 15.4 | 7.2 |
| A31 | $DyF_3$ | — | 800 | 16 | 0.009 | 11.2 | 22.2 |
| A32 | COATING | | 830 | 24 | 0.023 | 11.5 | 21.7 |
| A33 | | | 840 | 40 | 0.110 | 12.7 | 15.5 |
| A34 | | | 860 | 78 | 0.330 | 13.8 | 8.5 |
| A35 | $TbF_3$ | — | 800 | 26 | 0.050 | 12.3 | 26.0 |
| A36 | COATING | | 840 | 64 | 0.220 | 14.3 | 15.0 |
| A37 | | | 870 | 86 | 0.390 | 15.9 | 12.6 |
| A41 | | — | | | 0 | 11.0 | — |

TABLE 2

| SPECIMEN No. | FLUORIDE POWDER MIXED IN MAGNET POWDER | DENSITY OF SINTERED BODY ($g/cm^3$) |
|---|---|---|
| B1 | $LaF_3$ | 6.55 |
| B2 | $CeF_3$ | 7.19 |
| B3 | $PrF_3$ | 7.14 |
| B4 | $NdF_3$ | 7.36 |
| B5 | $DyF_3$ | 6.75 |
| B6 | $TbF_3$ | 6.50 |
| B7 | — | 7.12 |

The invention claimed is:

1. A method for producing a rare earth magnet material, comprising:

a preparation step of preparing a powder mixture of:

magnet powder being powder of a magnet alloy comprising a first rare earth element (hereinafter referred to as "R1") which is one or more rare earth elements, boron (B), and the remainder being iron (Fe) and inevitable impurities with or without a reforming element; and fluoride powder being powder of a fluoride, at least one of the magnet powder and the fluoride powder containing neodymium (Nd);

a heating step of heating a compact of the powder mixture, thereby obtaining a lump rare earth magnet material in which neodymium oxyfluoride which is a reaction product of oxygen or an oxide in the vicinity of particles of the magnet powder and the fluoride is distributed over all parts including not only a surface part but also an inner part thereof; and a diffusing step of diffusing a diffusing element comprising a third rare earth element (hereinafter referred to as "R3") which is one or more rare earth elements, from a surface to the inner part of the rare earth magnet material, wherein the diffusing element is dysprosium (Dy) or terbium (Tb), a ratio of fluoride powder to be mixed in the magnet powder relative to 100 atomic % of the total powder mixture is 0.1 to 10 atomic %, and the preparing step comprises adjusting the amount of the fluoride powder to be mixed in the powder mixture in accordance with an estimated amount of oxygen atoms to be contained in the rare earth magnet material.

2. The method for producing a rare earth magnet material according to claim 1, wherein the R1 is Nd.

3. The method for producing a rare earth magnet material according to claim 1, wherein the fluoride powder is powder of rare earth fluoride comprising a second rare earth element (hereinafter referred to as "R2") which is one or more rare earth elements, and fluorine (F).

4. The method for producing a rare earth magnet material according to claim 3, wherein the R2 is Nd.

5. The method for producing a rare earth magnet material according to claim 1, wherein the heating step is a sintering step for obtaining a sintered body of a compact of the powder mixture.

6. The method for producing a rare earth magnet material according to claim 1, wherein the magnet powder is NdFeB powder comprising an NdFeB alloy containing 27 to 35% by mass (hereinafter referred to as %) Nd and 0.8 to 1.5% B relative to 100% of the total mass of the magnet powder, and the fluoride powder is neodymium fluoride powder comprising neodymium fluoride.

* * * * *